US007198235B2

(12) United States Patent
Lenz

(10) Patent No.: US 7,198,235 B2
(45) Date of Patent: Apr. 3, 2007

(54) METHOD AND APPARATUS FOR THE TRANSMISSION OF INFORMATION BETWEEN TRACK AND VEHICLE OF A MODEL RAILROAD

(75) Inventor: Bernd Lenz, Giessen (DE)

(73) Assignee: Lenz Elektronik GmbH, Giessen (DE)

( * ) Notice: Subject to any disclaimer, the term of this patent is extended or adjusted under 35 U.S.C. 154(b) by 59 days.

(21) Appl. No.: 10/749,445

(22) Filed: Dec. 31, 2003

(65) Prior Publication Data

US 2004/0222331 A1 Nov. 11, 2004

(30) Foreign Application Priority Data

Jan. 13, 2003 (DE) ..... 103 01 051

(51) Int. Cl.
*B61L 21/00* (2006.01)

(52) U.S. Cl. ..... 246/34 CT; 264/630; 264/167 R; 264/121

(58) Field of Classification Search ..... 246/122 A, 246/167 R, 34 R, 34 B, 3, 2 R, 187 R, 63 A; 701/19, 22; 340/904, 693.1, 693.3, 47, 48; 455/45, 55; 83/820, 814, 846, 848, 851, 83/168, 34

See application file for complete search history.

(56) References Cited

U.S. PATENT DOCUMENTS

| | | | | |
|---|---|---|---|---|
| 2,990,964 A | | 7/1961 | Timmer | |
| 3,636,508 A | * | 1/1972 | Ogilvy et al. | 246/8 |
| 4,442,988 A | * | 4/1984 | Laurent et al. | 246/34 CT |
| 4,619,425 A | * | 10/1986 | Nagel | 456/34 R |
| 4,655,421 A | * | 4/1987 | Jaeger | 246/167 R |
| 4,720,067 A | * | 1/1988 | Jaeger | 246/34 B |
| 4,723,737 A | * | 2/1988 | Mimoun | 246/25 |
| 5,485,977 A | * | 1/1996 | Brown et al. | 246/167 R |
| 5,711,497 A | * | 1/1998 | Andrianos et al. | 246/34 B |
| 5,938,151 A | * | 8/1999 | Takasan et al. | 246/194 |
| 6,830,224 B2 | * | 12/2004 | Lewin et al. | 246/167 R |
| 6,853,312 B2 | * | 2/2005 | Lenz | 340/904 |
| 2004/0010356 A1 | * | 1/2004 | Lenz | 701/19 |

FOREIGN PATENT DOCUMENTS

| | | |
|---|---|---|
| DE | 22 61 992 A | 6/1974 |
| DE | 26 41 841 A | 7/1978 |
| DE | 28 48 354 A | 5/1980 |
| DE | 29 31 524 A | 2/1981 |

* cited by examiner

*Primary Examiner*—Frantz F. Jules
(74) *Attorney, Agent, or Firm*—Quarles & Brady LLP

(57) ABSTRACT

A method and apparatus for the transmission of information between a track (11, 12) and a vehicle (13, 14) located on the track in a model railroad system, whereby when electrical contact between the vehicle and track, such as between a wheel of the vehicle and a rail of the track, is lost, a capacitor that then exists between the vehicle and the track is used for the transmission of information.

16 Claims, 6 Drawing Sheets

Legend:

Channel R1: Track voltage (11)
Channel R2: Input (17)
Channel R3: Output (17)/input „S“ Flipflop (19)
Channel 1: Track voltage (12)
Channel 2: Input (18)
Channel 3: Output (18)/Input „R“ Flipflop (19)
Channel 4: Output Flipflop (19)

signal´s dc component: 10V signal´s ac component: 1,5Vss, frequency: 2MHz

Amplitude of a 50Hz-sine wave: 24 Vpp

Square wave signal: amplitude: 5 Vpp
frequency: approx. 2 kHz
dutycycle: approx. 25%

METHOD AND APPARATUS FOR THE TRANSMISSION OF INFORMATION BETWEEN TRACK AND VEHICLE OF A MODEL RAILROAD

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

Since the beginning of electric model railroading, secure contact between wheel and rail has presented one of the greatest challenges for developers. Without contact there is insufficient energy to run the train, let alone control the direction and speed of the vehicle. Additional new functions have also been made possible by the arrival of modem digital control systems.

The lack of energy to keep the train moving can be compensated, at least for a short period of time, by energy stored in the vehicle. The best-known example of this type of energy storage is a flywheel mounted on the motor shaft. In spite of the use of the flywheel and many other improvements, especially in the area of current transfer from the track to the vehicle, it is very common for a vehicle to come to a sudden stop because it has lost contact with the track. These sudden stops occur primarily during low-speed coupling and uncoupling operations on particularly critical areas of the track, such as switches and tracks that are not laid perfectly flat, as well as—understandably—on dirty tracks.

As described above, an on-board energy source represents one approach to a solution, and flywheels are in widespread use. Unfortunately, even the energy stored in a flywheel is insufficient to keep the vehicle from stopping when it is traveling at particularly slow speeds. Batteries or storage batteries have also been installed in the vehicles, although in the past that was possible only on wide-gauge model trains. Of course, small energy storage mechanisms with a very high energy density have recently become available, but even if this problem of energy supply has been solved, the question of control remains. The "mechanical" flywheel on the motor shaft automatically results in the correct direction and speed, although an "electrical" flywheel must be informed of the direction and speed in some other manner.

In isolated cases, therefore, a storage battery has been combined with a radio remote control system, wherein the radio remote control system takes over the motor control. Of course, that solves all the problems described above, but for price reasons and on account of the large amount of space such a system takes up, it has not been accepted in the market. The propagation conditions of HF signals and the related transmission problems are also complex, which means that ultimately, one problem has only been replaced with an even more complicated problem.

SUMMARY OF THE INVENTION

The present invention provides a method and apparatus for the transmission of information between a track and a vehicle located on the track in a model railroad system. The method and apparatus includes a capacitor, and the use of the capacitor, that exists or becomes existent between the vehicle and the track for the transmission of information in the event of a loss of electrical contact between the vehicle and the track. In other words, the invention uses the capability of a capacitance existing between the track and the vehicle as means for passing AC information signals from the track to the vehicle and vice versa, in case of a disruption of the galvanic electrical connection between the vehicle and the track, and provides means for detecting the AC information signals passed via the capacitance.

The object of the invention is to make available a control system for a model railroad which is reliable even in the event of disruptions in the contact between the vehicle and the rail, and is also economical. This object is achieved by the invention recited in the independent claims. The dependent claims define preferred developments of the invention.

This and still other objectives and advantages of the present invention will be apparent from the description which follows. In the detailed description below, a preferred embodiment of the invention will be described in reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

The invention is explained in greater detail below with reference to the accompanying drawings, in which.

DETAILED DESCRIPTION OF PREFERRED EMBODIMENTS

Figure 1:
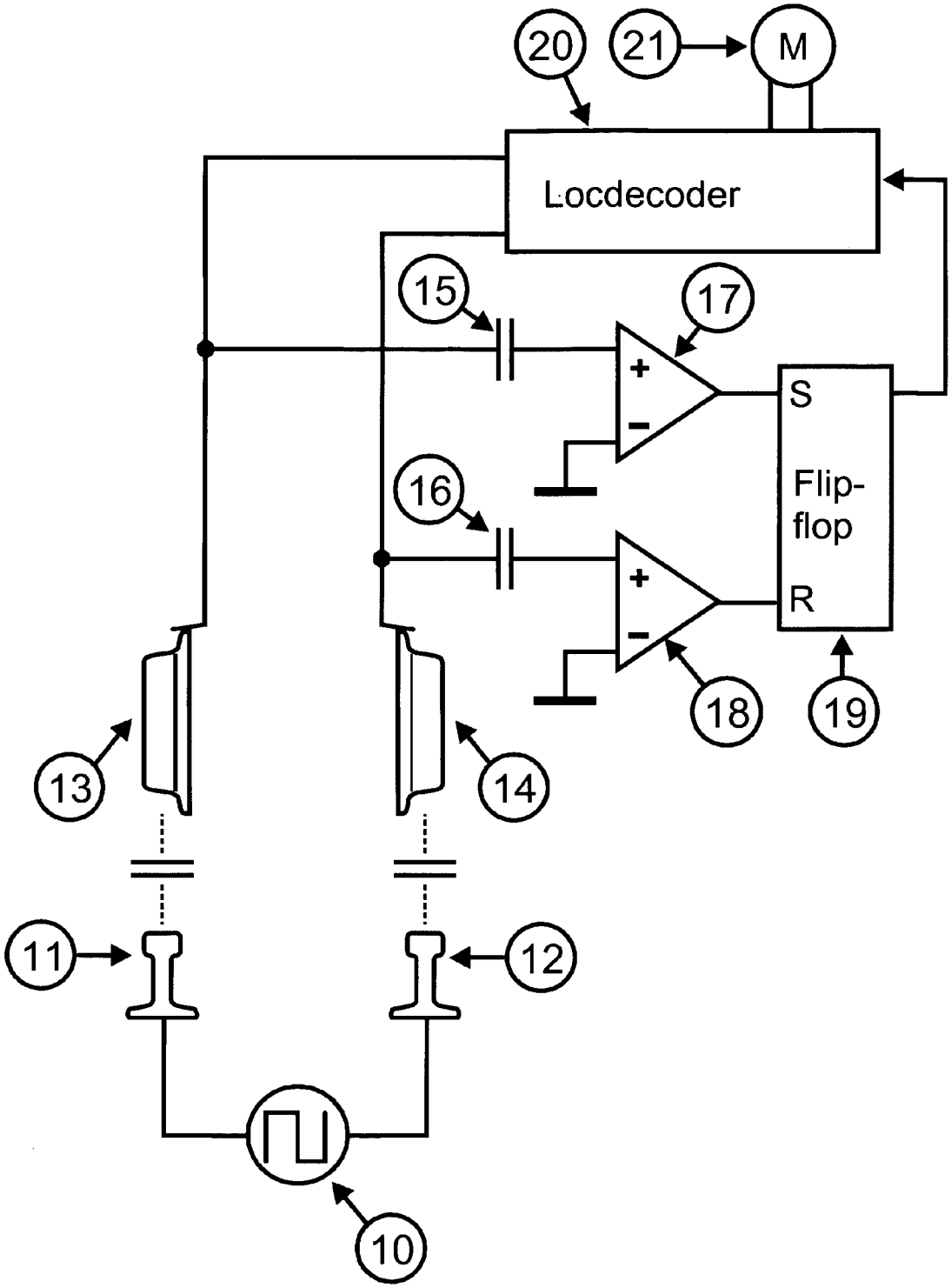
FIG. 1 is a schematic block diagram of one exemplary embodiment of the invention in the case of a digital control system.

The invention ensures a contact-less transmission of information between the track and vehicle of a model railroad system, without the use of radio-control means, as explained in greater detail below. If we consider the track and the wheel of a vehicle at the moment when they are no longer in electrical contact, we see two metal bodies facing each other and separated from each other either by air (e.g., if the track is not flat) or by an insulating mass (e.g., if the track is dirty). This situation corresponds to a capacitor which can only have a very low capacitance on account of the very small surfaces involved. The resulting capacitance is also a function of the number of vehicle wheels and the gauge, i.e., the size of the wheel and the track, and of the distance between the track and the wheel at the point where contact has been lost. Measurements on conventional model railroads have shown that the resulting wheel-rail capacitance is generally a few pF, although it can be less. On larger structures, e.g., on outdoor model railways, the capacitance values are higher.

It is known, of course, that capacitors block direct current voltage, but pass alternating current voltage. The invention takes advantage of this fact and the above explained capacitive coupling that exists between the wheel and the rail or between the vehicle and the rail. In particular, for this utilization, the capacitor that exists between the wheel and the rail can be supplemented or optionally replaced by additional capacitors between the vehicle and the rail. These additional or extra capacitors can be used not only additionally but also alternatively for the transmission of information. For the realization of the additional capacitors, additional contact pickup surfaces can be provided or existing contact pickup areas can be used. These existing or additional contact pickup surfaces are in particular sliding or wiping contacts that are attached to the vehicle.

In addition, any measure can be used that increases the capacitance between the vehicle and the rail in the event of the loss of contact. For this purpose, areas on the vehicle at a distance from the rail can also be used or enlarged. Moreover, the dielectric constant of the capacitor between the vehicle and rail or between the named surfaces and the rail can be increased. This can take place through the application of dielectric materials on vehicle surfaces. The above-mentioned capacitance values existing between the wheel and rail were increased considerably in this manner. The increase is dependent on the size of the model railway and the respective measures undertaken.

In addition, or as alternatives, to this increase in capacitance, the solutions described below can also be considered. The transmission of AC voltage using a capacitor can be described by two simple formulas. The first of these formulas is:

$$dU/dt=I/C \tag{1}$$

This formula says that the current, I, in a capacitor, C, becomes greater, the faster the change in voltage dU/dt at the capacitor. If we evaluate the current signals transmitted by the capacitor for signal interpretation, the invention teaches that we can expect usable results from all control systems used in model railroad systems that apply signals with steep edges to the track. Control systems of this type include pulse-width control systems in analog operation and in particular digital control systems in which, as a rule, a pulse-length and/or frequency modulated square wave voltage is applied to the track.

Because the AC voltages that are applied to the track in digital operation are only a few kHz, it is hardly practical to transmit data that can be evaluated directly. A direct transmission would be a transmission in which the same signal was available at the output of the capacitor as at the input. Given the generally small capacitances (in the range of a few pF) between the wheel and the rail, such a direct transmission would be almost impossible, or it would require extremely high input resistances. If we assume that we need one hundred times the time constant of an RC element to transmit a square wave signal approximately accurately, in this case, with a 10 kHz square wave signal and a wheel-rail capacitance of 1 pF, we would need an input resistance of 10 GOhm. Technically, of course, an input resistance that high can be realized, although it would be expensive and would take up a lot of space.

However, such low wheel-rail capacitances can supply brief spikes without excessive expense or effort in the frequencies in the kHz range in question here and in the case of square wave signals. In the event of the loss of electrical contact between the wheel and the rail, therefore, a capacitor that exists between the wheel and the rail can also be used for data transmission or data coupling at a significantly lower input resistance. Both in a conventional analog pulse-width control system as well as in commercial digital control systems, the information transmitted lies only in the length of the intervals of time between the edges of the square wave signal. Therefore the spikes resulting from the edges can be amplified and the complete information can be extracted from the spikes just as it was applied to the track. The solution can of course be combined with the measures described above to increase capacitance. In this case, moreover, the input resistance required for the above mentioned case of accurate transmission of a signal is correspondingly lower.

The invention therefore ensures a continuous transmission of information even in the event of an interruption of electrical contact with the track. The cost of the realization of the features claimed by the invention is very low and in the case of a digital control system as a component of a decoder (receiver), entails almost no additional costs, even if no constructive measures are taken to increase the capacitance.

An additional possibility of transmitting AC voltage current with a capacitor is described by the known second formula below:

$$R_c=1/\omega C \tag{2}$$

This equation describes the impedance or resistance $R_c$ of a capacitor as a function of the frequency. In the case of a wheel-rail capacitance of 1 pF, which is considered purely by way of example, if the alternating current to be transmitted has a frequency of 1 MHz, there results a resistance $R_c$ of approximately 160 kOhm. A resistance value on this order of magnitude can be utilized for the invention with little additional technical effort or expense. This is the case, for example, if the voltage on the track is a direct current or low-frequency alternating current voltage in the order of magnitude of the power supply frequency (50 to 60 Hz).

Using common methods that are readily available to a technician skilled in the art, a high frequency signal can be easily superimposed on such a voltage at a frequency which is preferably in the MHz range. Basically, lower frequencies can also be used down into the range above audio frequencies, although in that case the technical complexity and expense increase, the lower the frequency of the high-frequency signal imposed. The level of technical complexity can thereby be reduced if the above mentioned measures to increase capacitance are used or if, as a result of the shape of the vehicle, there is already a significantly higher capacitance between the wheel and the rail or between the vehicle and the rail. In this manner, the frequency of the superimposed voltage can be reduced further.

With direct current or low-frequency alternating current voltage on the track, the information to be transmitted is generally only the direction of travel, which can be done with a variety of superimposed frequencies. On the other hand, if the superimposed signal is not present, the motor is stopped.

With regard to the energy supply of the detection means used as claimed by the invention when there is an interruption of wheel-rail contact, it should be mentioned that a locomotive decoder or comparable decoder component or also a control component can always have a small energy storage mechanism, as in the prior art. When there is a brief interruption of the current, the energy-storage mechanism ensures the supply of energy to the decoder circuit for approximately 20 to 30 ms and thereby prevents an undesired resetting of the decoder in the event of an interruption of contact. This energy storage mechanism can also be advantageously used to supply energy to the detection and processing means for the above mentioned spikes or high-frequency superimposed signal, so that there is no need for a special energy storage mechanism for this purpose.

Even without any additional development, as a result of the features of the method and apparatus presented, there is already a perfect transmission of information to and from the track, which offers numerous advantages, in particular in a digital control system. Two essential improvements, for example, are: 1. There are no more "runaways". If, in digital operation, secure data no longer reaches the vehicle as a result of repeated and extremely brief interruptions, the vehicle can no longer be stopped or decelerated using normal commands. On the other hand, however, the interruptions are so brief that the motor still receives sufficient energy and the vehicle continues to run uncontrolled. The invention makes it possible to avoid such a situation. 2. For safety reasons, one and the same commands are always sent several times. This reduces the bandwidth of the system. If this is no longer necessary as a result of the utilization of the invention, more different commands can be transmitted at the same time.

With the contact-less transmission of information and data claimed by the invention and described above, in one advantageous development of the invention, a battery, a storage battery or a high-capacitance capacitor is connected to the motor control system in the interior of the vehicle where it acts as an energy-storage mechanism, to ensure, in addition to continuous control, a continuous energy supply for the traction motor.

In model railroading, therefore, contact problems have become a thing of the past once and for all. Even the rare case in which a vehicle comes to a stop precisely on a spot where there is no galvanic contact (in which case even a mechanical flywheel is of no use) is thereby eliminated, provided that the above mentioned energy supply to the traction motor is available.

In particular, as described above, when contact between the wheel and the rail is interrupted, the object of the invention and its advantageous developments is to minimize the cost and complexity of the detection of the AC current transmitted via the wheel-rail capacitor. In conventional digital control systems with square wave track signals in the kHz range, this object can be accomplished as described above. If, in a conventional analog operation of the system, an alternating current voltage is superimposed for the transmission of a control signal, the superimposed alternating current should be a square wave signal for an economical realization of the invention with frequencies in the kHz range. In the MHz range, a sinusoidal voltage can be used with little added technical complexity or expense. In the case of a superimposed square wave voltage, pulse-width modulation can be used to obtain different control signals, for example. In the MHz range, the direction of travel can be changed with a sinusoidal alternating current voltage, for example, by switching the frequency from 1 MHz to 2 MHz. In this case, the high-frequency sinusoidal voltage is transmitted as such via the wheel-rail capacitor. It can therefore be detected directly and does not need to be regenerated to ensure the transmission of the control signal even in the even of a loss of contact. This is also the case at frequencies that can even lie within the range of audio frequencies, with the measures to increase capacitance described above. The coupling of a superimposed alternating current voltage downstream of the so-called power pack of the system can be done by means of a choke and a capacitor, for example. In the locomotive, the alternating current can be recovered by means of this circuitry.

In a preferred embodiment shown in FIG. 1, a schematic block diagram of a locomotive incorporating the present invention based on a digital control system is shown. Already present is the track 11, 12 with the square wave voltage 10 of several kHz. Via the wheels with current pickups 13, 14, the voltage is transported to a decoder 20 where, after a corresponding interpretation of the information transmitted, a motor 21 can be controlled in the desired direction and speed. Newly added are coupling capacitors 15, 16, the task of which is only control-to-load isolation or voltage isolation, and two amplifiers 17, 18, the outputs of which are connected to the inputs of a RS flipflop 19. The RS flipflop 19 is connected with a data input of the decoder 20. In the event of an interruption in contact, the wheel-rail capacitors between the wheels and the track indicated by broken lines function as explained above.

To keep the attenuation of the spikes small, the coupling capacitances 15, 16 must be approximately ten times greater than the wheel-rail capacitances that depend on the type of application and the type of interruption. In addition, the coupling capacitances can be eliminated with the optional use of amplifiers that can handle or withstand the full track voltage. In the exemplary embodiment illustrated, the supply of energy to the amplifiers 17, 18 and the flipflop 19 is provided via the above-mentioned energy source (not shown) of the locomotive decoder 20. Instead, however, another additional small energy supply can be provided, or alternatively an additional energy source for the traction motor can be utilized.

Figure 2:
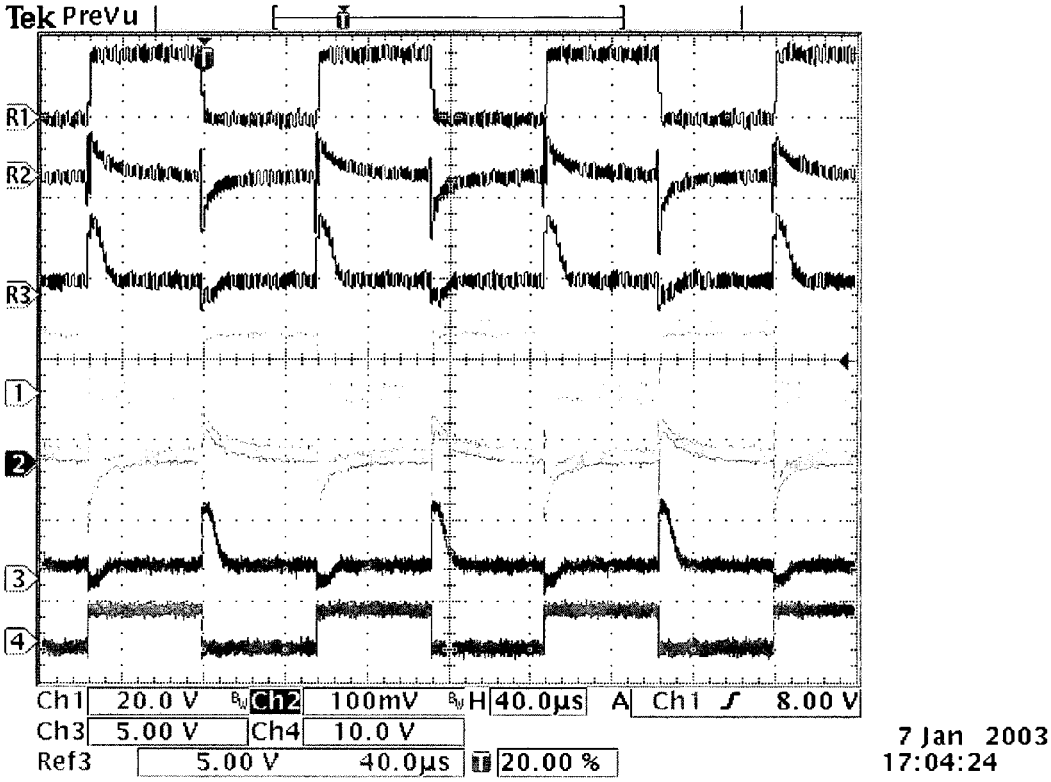
FIG. 2 shows the signals that occur at predetermined locations in the block diagram in FIG. 1.

FIG. 2 is an original recording on an oscilloscope of all the relevant signals from the embodiment shown in FIG. 1. Channel R1 shows the track voltage as it occurs at point 11. The amplitude is approximately 40 Vpp (Volt peak-to-peak). Channel R2 shows the voltage in the event of an interruption at the input of the amplifier 17. The sensitivity of the oscilloscope in this case is only 100 mV/cm. Channel R3 shows the signal amplified to 5 Volts, which can then be processed by the associated logic circuits. Channels 1, 2, 3 show the same situation, except from the other track, i.e., with a phase displacement of 180°. In this manner at the output of the flipflop 19, there is again a track signal (See Channel (4)) which is identical with regard to the timing and can be processed by the decoder 20.

The use of the capacitors or capacitances between 11, 12 and 13, 14 taught by the invention makes it possible to measure the edges of the square wave voltage in the form of spikes in the absence of electrical wheel-rail contact, to regenerate the square wave voltage from the spikes measured and to exploit the information or data it contains. The illustrated circuit is simple, economical and reliable, and has the advantage that it can also process the normally transmitted square wave voltage when there is contact between the wheel and the rail. The connections to the locomotive decoder 20 placed on the left in FIG. 1 can thereby still be used, but only for the energy supply, while when there is contact or no contact between the wheel and the rail, all of the data are is provided to the locomotive decoder 20 via the connection on the right.

A technician skilled in the art will be able to devise alternative solutions for the amplification and processing of the spikes via the above mentioned wheel-rail capacitances, which can be integrated into existing systems as an additional measure or, as in the exemplary embodiment illustrated, to reliably transmit the square wave voltage with or without wheel-rail contact. For example, the task of the flipflop 19 can also be performed by a microcontroller. When a microcontroller with integrated analog amplifiers is used, it is also possible to omit the amplifiers 17, 18. The measurement of the pulses and the regeneration of the track signal from them can be done using a wide variety of logic circuits. In generally, a technician skilled in the art will prefer the solution that is easiest and most economical for him. The interpretation of the regenerated track signal is done in the locomotive detector 20 in the manner described in the prior art.

Figure 3:
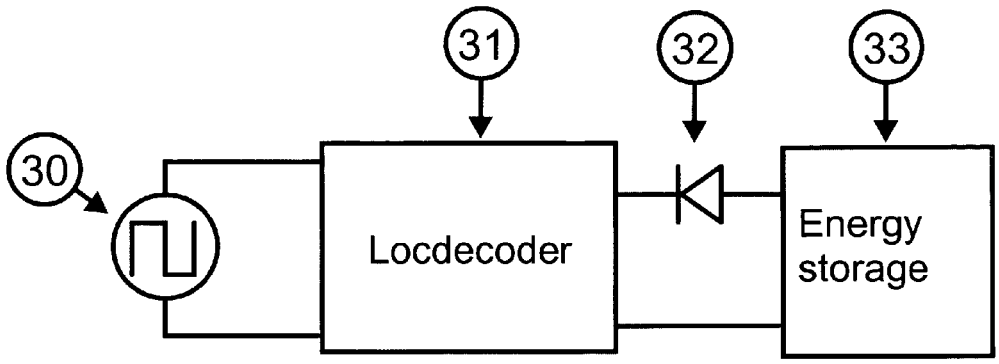
FIG. 3 is a block diagram of one advantageous development of the invention.

FIG. 3 shows how an additional energy storage device 33 can be connected. A diode 32 isolates the power supply of the decoder 31 (generally a bridge rectifier) from the energy-storage device 33. Only when the internal power supply voltage derived from the track voltage 30 falls below the value of the energy storage device 33 does the diode 32 become conducting and the decoder 31 is supplied with power from the energy storage device. The following types of devices can be used as the energy storage device: batteries, storage batteries, high-capacitance capacitors with a capacitance of several Farads, for example, fuel cells etc. In the case of regeneratable energy sources such as storage batteries or capacitors, these devices can be recharged via corresponding known charging circuits as soon as contact with the track is re-established.

Figure 4:
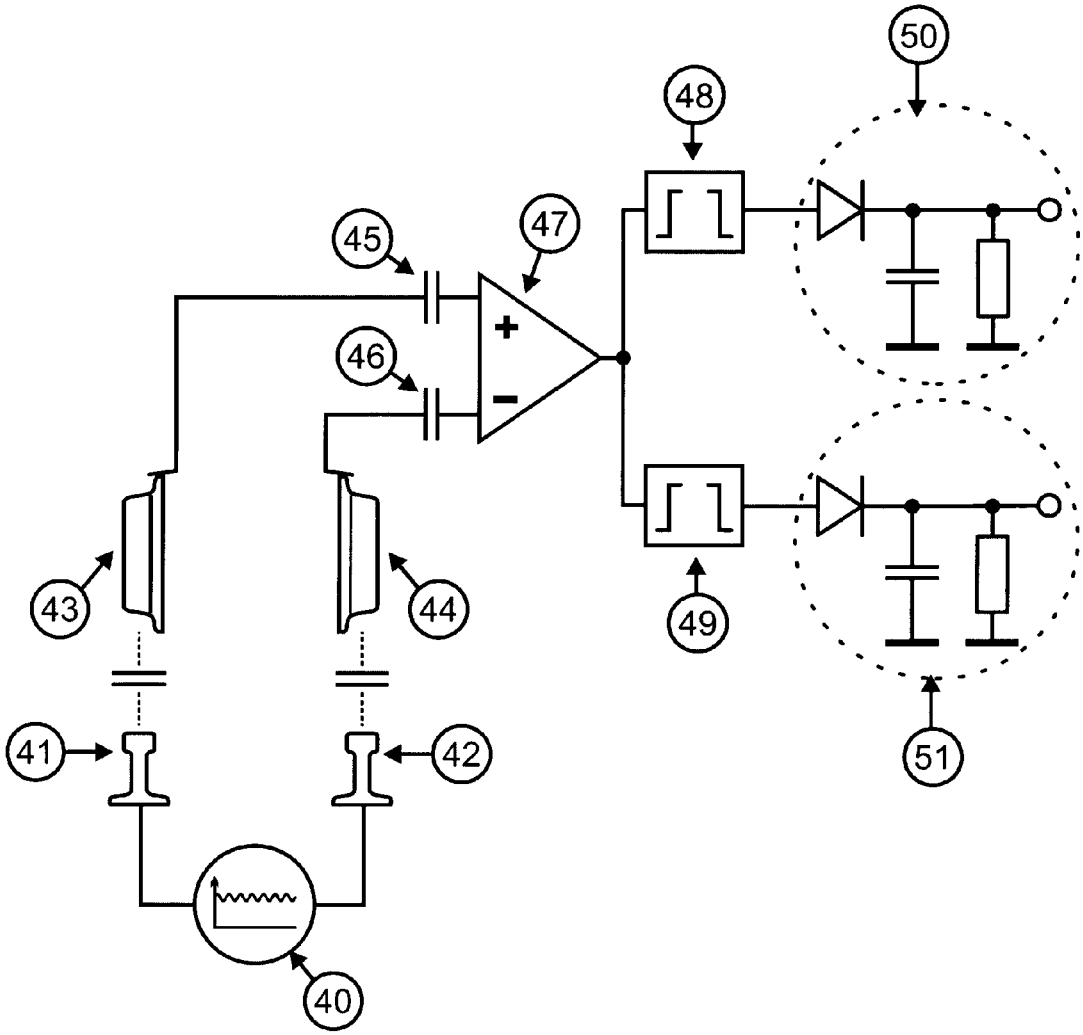
FIG. 4 is a schematic block diagram of an additional exemplary embodiment of the invention in the case of a direct current or low-frequency AC voltage on the track on which a high-frequency voltage is superimposed.

FIG. 4 shows an example of a detector for a high frequency superimposed on a DC or AC voltage. The track signal 40 applied to the track 41, 42 is in turn taken via additional capacitors 45, 46 from the wheels 43, 44 and transmitted to an amplifier 47 that is capable of handling high frequencies. The amplifier is selected so that in the case of "normal" rail contact, it can be overloaded and switches to limiting operation. At the output of the amplifier there are two bandpass filters 48, 49, each of which filters out the respective frequency of the superimposed high frequency in the case of a frequency modulation between two frequency values, e.g., 1 MHz and 2 MHz. Theoretically, only one signal frequency value or more than two frequency values are possible, with a corresponding number of processing channels behind the amplifier 47. Connected to the bandpass filters 48, 49 are two HF rectifiers 50, 51, the output voltage of which can be used to control a motor. The conventional power supply for the traction motor via the track voltage is not shown in this figure.

Figure 5:
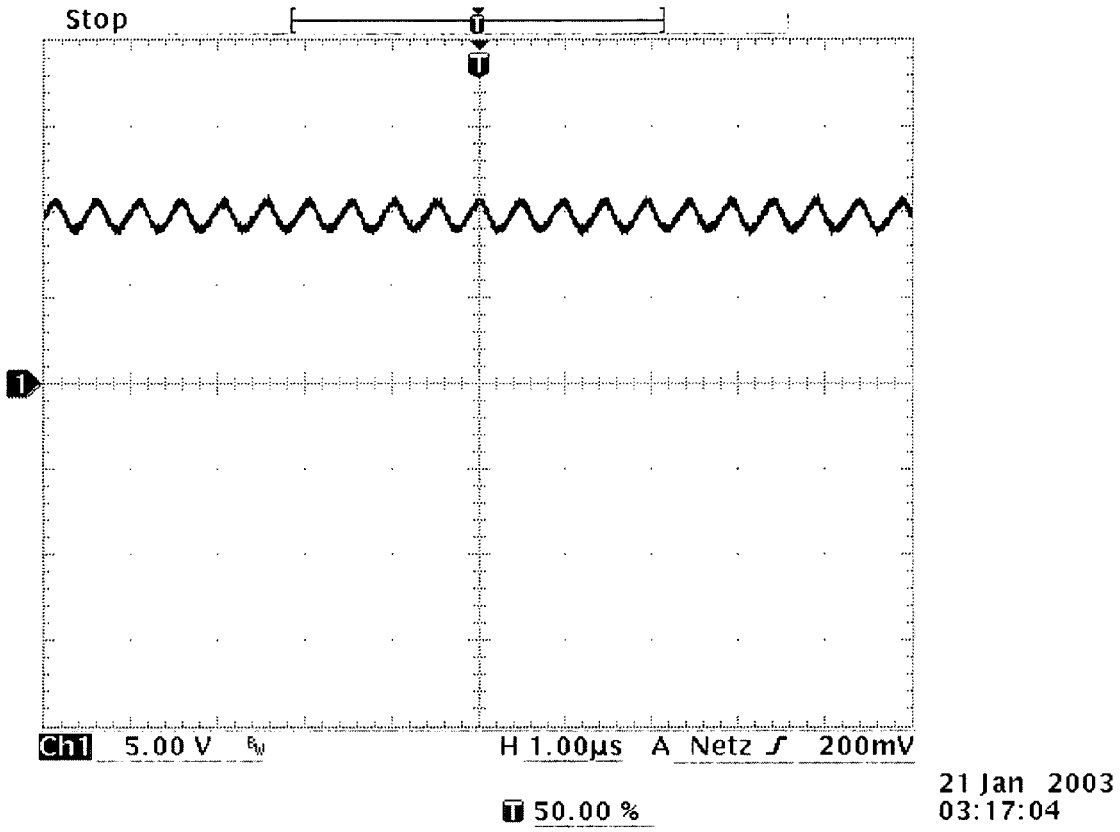
FIG. 5 is an example of a track voltage in the form of a direct current voltage with a superimposed high-frequency alternating current voltage.

FIG. 5 shows an example of the track voltage 40 for processing in the circuit illustrated in FIG. 4. In this case, a higher-frequency sine-wave AC voltage in the MHz range is superimposed on a DC voltage. Instead of the illustrated DC voltage, the track voltage can also be a low-frequency AC voltage of 50, 60 Hz or a similar value, the AC voltage superimposition on which is detected by the high frequency detector illustrated in FIG. 4, although the high frequency detector can also be designed in some other manner.

Figure 6:
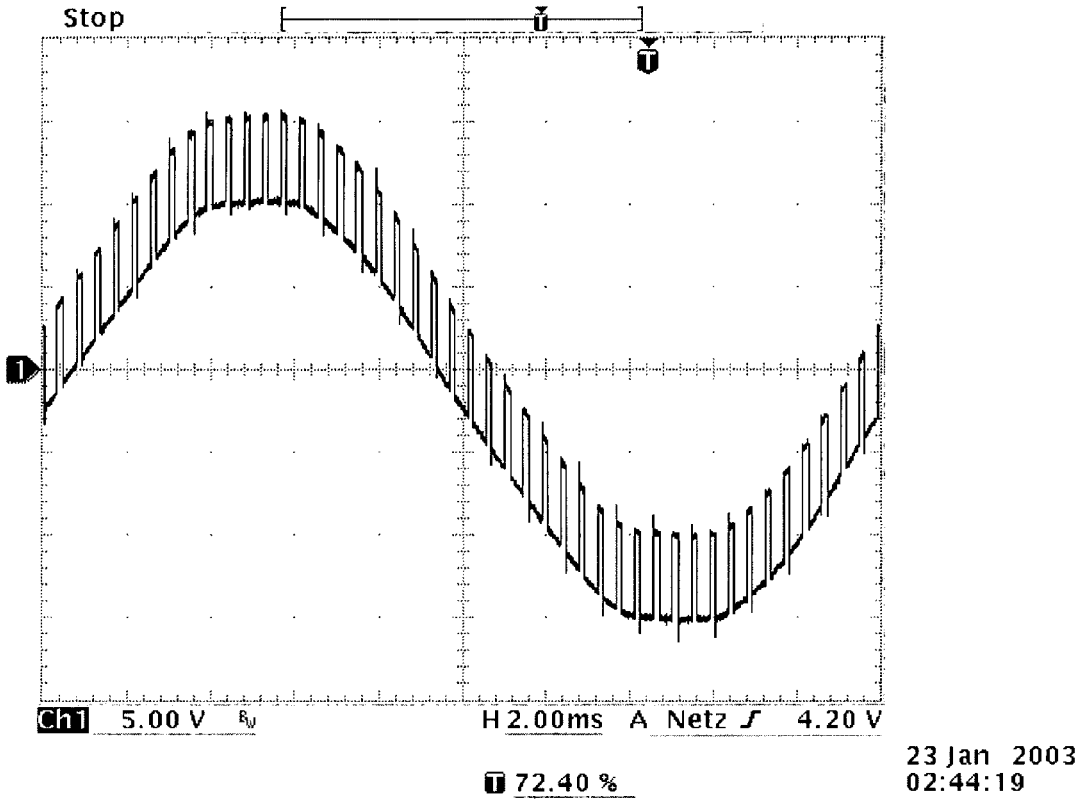
FIG. 6 is an example of a track voltage in the form of a low-frequency sine-wave alternating current voltage with a superimposed higher-frequency square wave.

FIG. 6 shows another form of a possible superimposition in the form of a pulse-width modulated square wave voltage in the kHz range on a low-frequency 50 Hz sinusoidal signal as the track signal. With this voltage form, the detector illustrated in FIG. 1 or another type of spike detector would be used to regenerate the pulse-width modulated square wave voltage from the spikes. If the corresponding information is not being transmitted, the pulse-width modulation of the square wave voltage can be omitted. If the track signal is a DC voltage, a square wave voltage or a pulse-width modulated square wave voltage can also be superimposed on it. Instead of or in addition to the pulse-width modulation, it is also possible to use frequency modulation. This statement also applies for the square wave voltage 10 in FIG. 1, which can be pulse-width modulated and/or frequency modulated.

An energy storage device as illustrated in FIG. 3 can be provided in all embodiments.

In the examples explained with reference to the accompanying figures, there are no measures to increase capacitance. If these measures are provided or used, then the capacitors that also exist between the vehicle and the rail must be arranged so that they lie parallel to the wheel-rail capacitor. If they are not used additionally but alternatively, they are connected like the wheel-rail capacitor to corresponding detection means.

The following components were used in one exemplary embodiment of the invention:

FIG. 1:

Decoder 20: LE1025, Manufacturer: Lenz

Capacitors 15 and 16: 100 pF

Comparators 17 and 18 in the hardware contained in a microprocessor PIC16F628, whereby in the processor, the flipflop 19 was simulated in software

FIG. 4:

Capacitors 45 and 46: 100 pF

Differential amplifier 47: Burr Brown OPA353 with additional output voltage limiter.

Bandpass filters 48 and 49:

LRC bandpass filters with Quality Q=10.

Center frequency:

for bandpass filter 48: fo=1 MHz for bandpass filter 49: fo=2 MHz

HF rectifier 50:

Diode: 1N 4148

C=22 pF

R=220 kΩ

HF rectifier 51:

Diode: 1N 4148

C=10pF

R=220 kΩ

While there has been shown and described what are at present considered the preferred embodiments of the invention, it will be obvious to those skilled in the art that various changes and modifications can be made therein without departing from the scope of the invention defined by the appended claims.

I claim:

1. A method for the transmission of information between a track and a vehicle located on the track in a model railroad system, said method comprising:

using at least one capacitor that exists between the vehicle and the track for the transmission of information in the event of a loss of electrical contact between the vehicle and the track, and detecting the information transmitted via said capacitor, wherein the capacitor is formed by surfaces of the vehicle and the track, particular of a wheel of the vehicle and of the track, said surfaces opposing each other by a loss of contact.

2. The method as claimed in claim 1, in which the loss of electrical contact between the vehicle and the track includes a loss of electrical contact between a wheel of the vehicle and a rail of the track, and said capacitor is between the wheel and the rail.

3. The method as claimed in claim 2, in which the model railroad system has one of a DC voltage and a low-frequency AC voltage applied to the track, the method includes superimposing a higher-frequency information transmission signal on the one of the DC voltage and the low-frequency AC voltage, and detecting the information transmission signal via the capacitor.

4. The method as claimed in claim 1, in which using said at least one capacitor which exists between the vehicle and the track is supplemented by the provision of additional capacitors between the vehicle and the track, wherein said additional capacitors are realized by at least one of the following measures: the provision of additional contact pickup areas; the utilization of existing additional contact pickup areas between the vehicle and the track; the utilization of areas on the vehicle that are relatively far from the track; and an increase of the dielectric constant of the capacitor between the vehicle and the track.

5. The method as claimed in claim 1, wherein the model railroad system uses a square wave voltage as the information transmission signal, and the method includes detecting and evaluating spikes that occur in said at least one capacitor.

6. The method as claimed in claim 5, in which said square wave voltage is selected from a group consisting of a track signal of a digital model railroad system which is modulated according to control information, whereby the square wave voltage is regenerated from the spikes and a square wave voltage which is superimposed on a DC or AC voltage that is applied to the track, whereby the information to be transmitted is regenerated from the spikes.

7. The method as claimed in claim 1, in which the model railroad system has one of a DC voltage and a low-frequency AC voltage applied to the track, the method includes superimposing a higher-frequency information transmission signal on the one of the DC voltage and the low-frequency AC voltage, and detecting the information transmission signal via the capacitor.

8. The method as claimed in claim 1, including providing a supply of energy when there is no electrical contact between the track and the vehicle using an energy-storage device (33).

9. An apparatus for the transmission of information between a track and a vehicle located on the track in a model railroad system, said apparatus comprising:

at least one capacitor formed between the vehicle and track and constituting a means for the transmission of information comprised in a signal applied to the track, wherein the capacitor is formed by surfaces of the vehicle and the track, particular of a wheel of the vehicle and of the track, said surfaces opposing each other by a loss of contact; and means (15, 16, 17, 18, 19; 45, 46, 47, 48, 49, 50, 51) for detecting and processing signals transmitted via said capacitor in the event of the loss of electrical contact between the vehicle and the track.

10. The apparatus as claimed in claim 9, in which said capacitor is formed between a wheel of the vehicle and a rail of the track, and said means (15, 16, 17, 18, 19; 45, 46, 47, 48, 49, 50, 51) for detecting and processing said signals detects and processes said signals in the event of the loss of electrical contact between the wheel of the vehicle and the rail.

11. The apparatus as claimed in claim 9, in which at least one additional capacitor is provided between the vehicle and the track, said at least one additional capacitor is realized by at least one of the following measures: the provision of additional contact pickup areas; the utilization of existing additional contact pickup areas between the vehicle and the track; the utilization of areas on the vehicle that are spaced from the track; and an increase of the dielectric constant of the capacitor between the vehicle and the track.

12. The apparatus as claimed in claim 9, in which the signals transmitted are spikes that originate from a square wave information signal, and said means (15, 16, 17, 18, 19) contain a circuit that detects the spikes and from them regenerates the information to be transmitted.

13. The apparatus as claimed in claim 9, in which the signals transmitted are spikes and the spikes originate from a square wave voltage that is modulated in accordance with digital control information, and said means (15, 16, 17, 18, 19) for detecting and processing said signals includes a logic circuit (19) which regenerates control information from the amplified spikes.

14. The apparatus as claimed in claim 9, in which the signals to be detected by the means for detecting and processing said signals are in the form of an AC voltage which is superimposed on an analog track voltage, and which is transmitted via the capacitor that exists between the vehicle and the rail even in the event of the loss of electrical contact between the vehicle and the track.

15. The apparatus as claimed in claim 9, including an energy-storage device (33) to provide a supply of energy when there is no electrical contact between the track and the vehicle.

16. A method for the transmission of information between a track and a vehicle located on the track in a model railroad system, said method comprising:

using a capacitor for the transmission of transmission of information in the event of a loss of electrical contact between the vehicle and the track, said capacitor resulting from said lack of electrical contact between the vehicle and the track, wherein the capacitor is formed by surfaces of the vehicle and the track, particular of a wheel of the vehicle and of the track, said surfaces opposing each other by a loss of contact.

* * * * *

UNITED STATES PATENT AND TRADEMARK OFFICE

CERTIFICATE OF CORRECTION

PATENT NO. : 7,198,235 B2
APPLICATION NO. : 10/749445
DATED : April 3, 2007
INVENTOR(S) : Bernd Lenz It is certified that error appears in the above-identified patent and that said Letters Patent is hereby corrected as shown below:

Column 1, line 23, “modem” should be changed to -- modern --;

Column 10, line 44, claim 16, delete second instance of “transmission of”.

Signed and Sealed this

Twelfth Day of June, 2007

JON W. DUDAS
*Director of the United States Patent and Trademark Office*